United States Patent [19]

Reeve

[11] Patent Number: 4,553,792

[45] Date of Patent: Nov. 19, 1985

[54] STRUCTURAL SLIDE BEARING

[75] Inventor: William E. Reeve, Hemingford Grey, England

[73] Assignee: Dixon International Limited, England

[21] Appl. No.: 538,102

[22] Filed: Oct. 3, 1983

[30] Foreign Application Priority Data

Oct. 1, 1982 [GB] United Kingdom ..... 8228063

[51] Int. Cl.[4] ..... F16C 29/02

[52] U.S. Cl. ..... 308/3 R; 52/167

[58] Field of Search ..... 308/3 R, 3 A, 3.6, 3 C; 52/167

[56] References Cited

U.S. PATENT DOCUMENTS 3,350,821 11/1967 Jones ..... 52/167
3,484,064 12/1969 Koenig ..... 308/3 R
3,782,788 1/1974 Koester et al. ..... 308/3 R
4,238,137 12/1980 Furchak et al. ..... 308/3 R

*Primary Examiner*—Lenard A. Footland
*Attorney, Agent, or Firm*—Bucknam and Archer

[57] ABSTRACT

A structural bearing comprising a bottom bearing plate and a top bearing plate, the bearing having sliding surfaces in mutual sliding contact and fixed against horizontal movement relative to the bottom bearing plate and the top bearing plate respectively, one of the bearing plates being provided with one or more spigots engaging in slots in the other bearing plate, the spigot(s) substantially preventing relative rotation of the bearing plates about a vertical axis and substantially preventing relative horizontal movement of the plates in one direction but allowing relative horizontal movement of the plate in a direction normal (i.e. at a right angle) thereto.

4 Claims, 4 Drawing Figures

STRUCTURAL SLIDE BEARING

The present invention relates to a structural slide bearing. Such a bearing may be for a building structure or may be a bridge bearing.

A known structural slide bearing comprises a lower bearing plate, an intermediate module which is resiliently deformable and an upper bearing plate. The intermediate module is for absorbing relative rotational movement about a horizontal axis between the upper and lower bearing plates. The intermediate module and one of the bearing plates have respective mutually engaging sliding surfaces so that the upper bearing plate can slide horizontally relative to the lower bearing plate. To laterally restrain this sliding movement so that the upper bearing plate can slide horizontally relative to the lower bearing plate in one direction only, one of the bearing plates is provided with guide members on opposite edges thereof. These guide members slidingly engage with opposite edges of the other bearing plate so that relative sliding movement of the bearing plates can take place only in a direction parallel to the guide members.

The guide members are bolted onto the edges of said one bearing plate. This necessitates the boring of holes in the edges of that bearing plate and tapping threads in the holes. This is both expensive and time consuming. Moreover the bolts are necessarily made of high tensile steel and accordingly are liable to rust in use and hence become weakened. Thus the guide member become liable to break off the bearing plate. Stainless steel bolts cannot be used because they would be of insufficient tensile strength.

The present invention aims to overcome or mitigate the aforementioned disadvantages.

In accordance with the present invention, there is provided a structural bearing comprising: a bottom bearing plate and a top bearing plate, the bearing having sliding surfaces in mutual sliding contact and fixed against horizontal movement relative to the bottom bearing plate and the top bearing plate respectively, one of the bearing plates being provided with one or more spigots engaging in slots in the other bearing plate, the spigot(s) substantially preventing relative rotation of the bearing plates about a vertical axis and substantially preventing relative horizontal movement of the plates in one direction but allowing relative horizontal movement of the plate in a direction normal (i.e. at a right angle) thereto.

Thus by virtue of the provision of the spigots and the elongate slots the bearing need not comprise any guide members bolted to edges of either bearing plate.

The or each spigot is preferably located in a recess in the bearing plate to which it is attached.

Preferably the or each spigot is elongate in shape (as viewed in plan) and of a width such as to be a sliding fit in the corresponding slot.

Where the spigot is elongate in shape only one spigot and one corresponding slot need be provided although it may be preferable to provide two or more spigots and corresponding slots.

Preferably there is disposed between the top and the bottom bearing plate at least one layer of rubber or other elastomeric material (hereinafter referred to as "rubber") for absorbing relative rotational movement about a horizontal axis between the top and bottom bearing plates.

The layer of rubber may be provided in one or more modular elements, which carry one of the sliding surfaces and include at least one metal sheet keyed to one of the bearing plates.

Where there are a plurality of modular elements, they may be arranged side-by-side or may be arranged in a stack, adjacent metal plates of adjacent elements being keyed together.

The sliding surfaces in mutual sliding contact are preferably provided by polytetrafluoroethylene and stainless steel.

The invention is further described below by way of example with reference to the accompanying drawings, wherein.

In the drawings like reference numerals indicate like parts.

Figure 1:
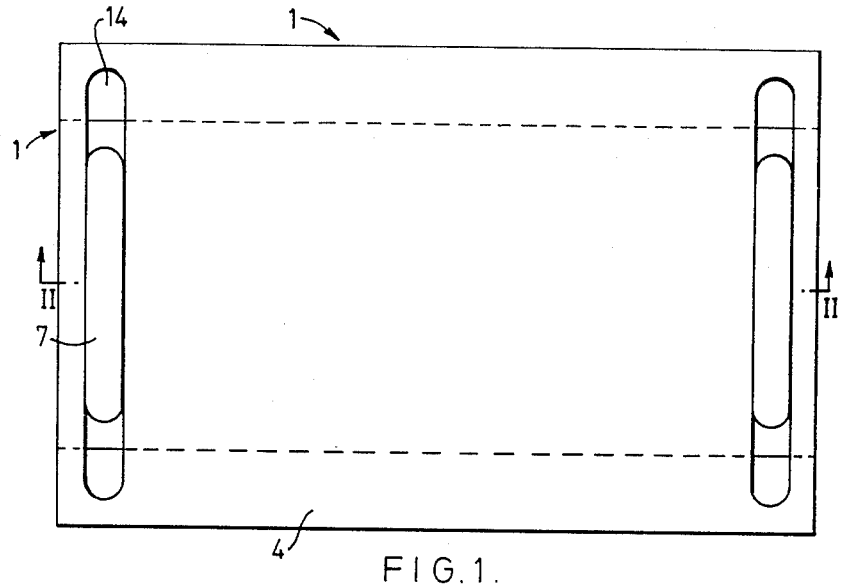
FIG. 1 is a plan view of a first bearing according to the invention, an outer module having been removed.
Figure 2:
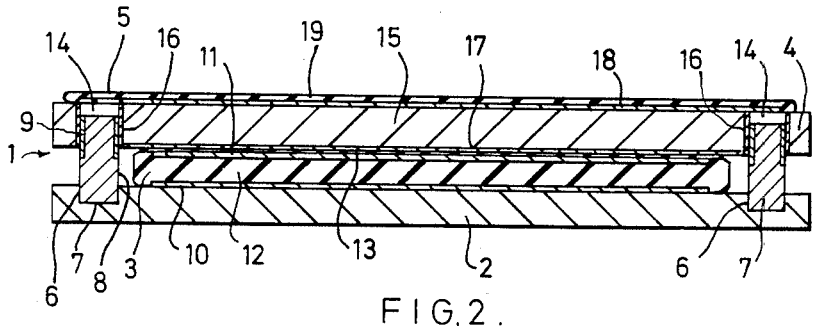
FIG. 2 is a section along line II—II of FIG. 1 and shows the outer module.

Referring to FIGS. 1 and 2, a structural bearing 1 comprises a bottom bearing plate 2, an intermediate module 3, a top bearing plate 4 and an outer module 5.

The bottom bearing plate 2 is a thick steel plate having elongate mutually parallel recesses 6 machined into its upper surface. In each recess is located an elongate spigot 7, the spigot being welded at 8 to the upper surface of the plate 2.

The spigots 7 are of high tensile steel (which is capable of rusting on exposure to normal damp atmospheric conditions).

The upper portions of the sides of the spigots 7 have recesses or rebates machined therein and polytetrafluoroethylene (ptfe) strips 9 are located in these recesses or rebates and bonded or cemented to the spigots so as to be flush with the lower portions of the sides of the spigots.

The intermediate module 3 comprises two steel sheets 10 and 11 and a thick vulcanized rubber layer 12. The steel sheets 10 and 11 are bonded at their upper and lower sides respectively and at their edges to the rubber layer 12, the rubber layer extending around the edges of the steel sheets to be flush with their upper and lower surfaces respectively. To the upper surface of the steel sheet 11 and the rubber layer 12 is bonded a ptfe layer 13.

The module 3 is mechanically located to the bottom bearing plate 2 so as to be horizontally fixed relative to the bottom bearing plate. For example the bottom bearing plate 2 is provided with a plurality of recesses (not shown) machined into its top surface, the steel plate 10 is provided with a plurality of openings (not shown) cut thereinto and metal keys are located in the recesses and the openings, a single one of the keys engaging in each recess and corresponding opening, each recess, corresponding opening and corresponding key being like size and shape in plan view. Alternatively the bottom bearing plate 2 has only a single acircular recess machined thereinto, the steel plate 10 has a single acircular opening of the like size and shape in plan as the recess, cut thereinto and a single key of like size and shape in plan is located in the recess and the opening. The acircular shape of the recess, the opening and the key is preferably cruciform.

The top bearing plate 4 comprises a thick steel plate 15 having two mutually parallel elongate slots 14 machined therein, the slots being longer than the spigots 7 of the bottom bearing plate 2. The sides of the slots 14 are lined with stainless steel strips 16 welded to the thick steel plate 4. To the lower surface of the steel plate 15 is bonded or cemented a stainless steel sheet 17.

The spigots 7 of the bottom bearing plate 2 are located in the slots 14 of the top bearing plate, the stainless steel sheet 17 of the top bearing plate slidingly resting on the ptfe layer 13 of the intermediate module 3 and the ptfe strips 9 of the spigots slidingly engaging with the stainless steel strips 16 of the top bearing plate.

The top bearing plate 4 is accordingly capable of undergoing horizontal sliding movement in the direction of the spigots 7 and the slots 14 relative to the intermediate module 3 and the bottom bearing plate.

The outer module 5 comprises a steel sheet 18 and a rubber layer 19 bonded to the upper surface and the edge of the steel sheet and flush with the lower surface of the steel sheet.

The outer module 5 is mechanically located on the top bearing plate 4 so as to be horizontally fixed relative to the top bearing plate. The mechanical location may be achieved by keying together the steel sheet 18 and the steel plate 15 in a manner as described above for keying together the steel sheet 10 and the bottom bearing plate 2.

In use the bearing is positioned on a lower supporting part of a structure and then an upper supported part of the structure is positioned on the bearing.

The bottom bearing plate 2 may be fixed in position on the lower supporting part of the structure by friction alone or dowels or bolts engaging in the bottom bearing plate and the lower supporting part may be provided to achieve this fixing.

The upper supporting part is held in position on the bearing by frictional engagement with the rubber layer 19 of the module 5.

The slots 14 allow the upper bearing plate 4 and the outer module 5 and hence the upper supported part of the structure to undergo horizontal unidirectional movement relative to the bottom bearing plate 2 and the lower supporting part of the structure, this unidirectional movement being in the lengthwise direction of the slots 14.

The spigots 7 provide lateral restraint of the movement of the upper bearing plate, and the outer module and the upper supported part of the structure. Specifically the upper plate 4, the module 5 and the upper supported part are prevented from undergoing horizontal movement in a direction normal to the lengthwise direction of the spigots 7.

Rotational movement of the upper supported part of the structure (and hence of the module 5 and the upper bearing plate 4) about a horizontal axis normal to the lengthwise direction of the spigots, is absorbed by deformation of the thick rubber layer 12 of the intermediate module 3.

It will be appreciated that the spigots 7 can be freely located in the bottom bearing plate 2 and that the bearing does not comprise any bolts which are either weak or liable to rust. In fact the use of bolts is avoided altogether.

Figure 3:
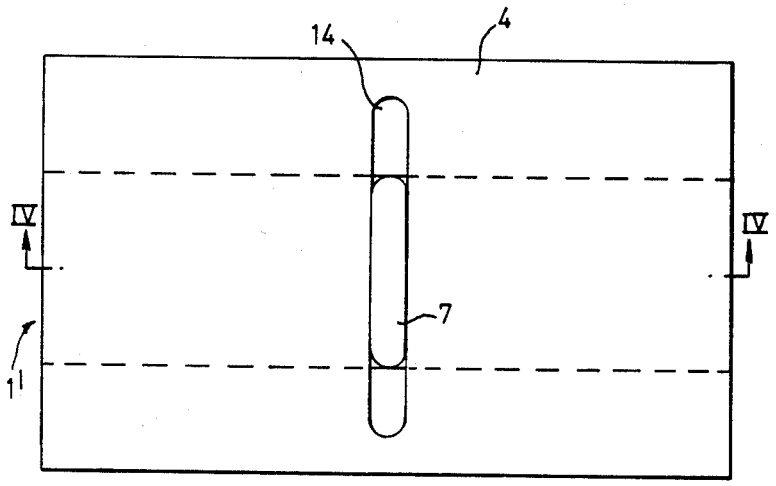
FIG. 3 is a plan view of a second bearing according to the invention, an outer module having been removed.
Figure 4:
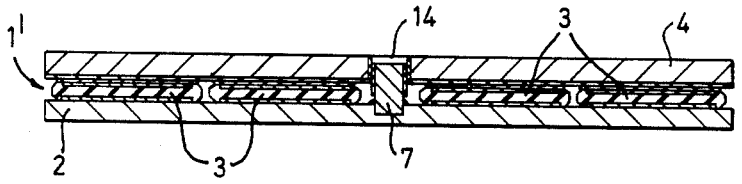
FIG. 4 is a section along line III—III of FIG. 3, the outer module not being shown.

The bearing shown in FIGS. 3 and 4 is similar to that shown in FIGS. 1 and 2 except as described below.

Referring to FIGS. 3 and 4, the bottom plate 2 of the bearing 1' has only one spigot 7, which is disposed centrally of the bottom plate. The top plate 4 similarly has only one elongate slot 14. Four intermediate modules 3 are provided, two on either side of the spigot 7. The modules 3 are of similar construction to the modules 3 of FIGS. 1 and 2 but smaller in areas relative to the top and bottom bearing plates 2 and 4, the pfte layers 13 of the modules providing one sliding surface which slidingly contacts the stainless steel sheet 17 of the top bearing plate 4.

The outer module 5 is not shown in FIGS. 3 and 4 for the sake of convenience only.

The bearing of FIGS. 3 and 4 is used and functions in like manner to the bearing of FIGS. 1 and 2.

I claim:

1. A structural bearing comprising: a bottom bearing plate and a top bearing plate; sliding surfaces in mutual sliding contact and fixed against horizontal movement relative to the bottom bearing plate and the top bearing plate respectively; one of the bearing plates being provided with one or more spigots engaging in slots in the other bearing plate, the spigot(s) substantially preventing relative rotation of the bearing plates about a vertical axis and substantially preventing relative horizontal movement of the plates in one direction but allowing relative horizontal movement of the plate in a direction normal thereto, wherein there is disposed between the top and bottom bearing plate at least one layer of rubber or other elastomeric material for absorbing relative rotational movement about a horizontal axis between the top and bottom bearing plates.

2. A bearing according to claim 1, wherein the layer of elastomeric material is provided in one or more modular elements, which carry one of the sliding surfaces and include at least one metal sheet keyed to one of the bearing plates.

3. A structural bearing according to claim 2, wherein there is a plurality of said modular elements arranged in a stack, adjacent metal plates of adjacent elements being keyed together.

4. A structural bearing comprising: a bottom bearing plate and a top bearing plate; sliding surfaces in mutual sliding contact and fixed against horizontal movement relative to the bottom bearing plate and the top bearing plate respectively; one of the bearing plates being provided with one or more spigots engaging in slots in the other bearing plate, the spigot(s) substantially preventing relative rotation of the bearing plates about a vertical axis and substantially preventing relative horizontal movement of the plates in one direction but allowing relative horizontal movement of the plate in a direction normal thereto, wherein the sliding surfaces in mutual sliding contact are provided by polytetrafluoroethylene and stainless steel respectively.

* * * * *